US007825880B2

(12) United States Patent
Yumoto et al.

(10) Patent No.: US 7,825,880 B2
(45) Date of Patent: Nov. 2, 2010

(54) PIXEL CIRCUIT

(75) Inventors: Akira Yumoto, Kanagawa (JP); Mitsuru Asano, Kanagawa (JP); Seiichiro Jinta, Kanagawa (JP)

(73) Assignee: Sony Corporation, Tokyo (JP)

( * ) Notice: Subject to any disclaimer, the term of this patent is extended or adjusted under 35 U.S.C. 154(b) by 715 days.

(21) Appl. No.: 11/889,357

(22) Filed: Aug. 13, 2007

(65) Prior Publication Data

US 2008/0048955 A1 Feb. 28, 2008

(30) Foreign Application Priority Data

Aug. 23, 2006 (JP) ..... 2006-226754

(51) Int. Cl.
*G09G 3/30* (2006.01)

(52) U.S. Cl. ..... 345/77; 345/80

(58) Field of Classification Search ..... 345/77, 345/76, 80, 82; 315/169.3; 313/483
See application file for complete search history.

(56) References Cited

FOREIGN PATENT DOCUMENTS

| | | |
|---|---|---|
| JP | 08-234683 | 9/1996 |
| JP | 2002-514320 A | 5/2002 |
| JP | 2005-173434 | 6/2005 |

*Primary Examiner*—Ricardo L Osorio
(74) *Attorney, Agent, or Firm*—Rader, Fishman & Grauer PLLC

(57) ABSTRACT

A pixel circuit is disposed where a scan line arranged in a row direction to supply a control signal and a data line arranged in a column direction to supply a video signal intersect each other. The pixel circuit includes: a sampling transistor; a drive transistor; a capacitor connected between the current path end of the sampling transistor and the gate of the drive transistor; and a light-emitting device connected to the current path end of the drive transistor. The pixel circuit connects the mobility with negative feedback during a mobility connection period.

8 Claims, 12 Drawing Sheets

PIXEL CIRCUIT

CROSS REFERENCES TO RELATED APPLICATIONS

The present invention contains subject matter related to Japanese Patent Application JP 2006-226754 filed with the Japan Patent Office on Aug. 23, 2006, the entire contents of which being incorporated herein by reference.

BACKGROUND OF THE INVENTION

1. Field of the Invention

The present invention relates to a pixel circuit for current-driving a light-emitting device in each pixel. The invention relates particularly to an active pixel circuit which controls the amount of current supplied to a light-emitting device such as organic EL device using insulated gate field effect transistors disposed in the pixel circuit. The invention relates more specifically to a technique of correcting variations in mobility of a drive transistor adapted to drive a light-emitting device formed in each pixel circuit.

2. Description of the Related Art

In an image display apparatus such as liquid crystal display, a number of liquid crystal pixels are arranged in a matrix form. An image is displayed on such a display device by controlling the transmitted or reflected intensity of the incident beam for each pixel according to the image information to be displayed. The same holds true for an organic EL display using organic EL devices as its pixels, except that it is a self light-emitting device. For this reason, organic EL displays offer advantages over liquid crystal displays, including higher image visibility, no necessity of backlight and higher response speed. Further, the brightness level (grayscale) of each light-emitting device can be controlled by adjusting the current flowing through the device. Organic EL displays are significantly different from voltage-controlled displays such as liquid crystal displays in that they are so-called current-controlled displays.

As with liquid crystal displays, there are two methods of driving organic EL displays, namely, simple matrix and active matrix. Despite its simplicity in structure, the former has several problems, including difficulties in providing a large-sized display with high definition. Therefore, development activities for active matrix displays are proceeding at a brisk pace. This driving method is designed to control the current flowing through the light-emitting device in each pixel circuit using active devices (generally thin film transistors or TFTs) provided in the pixel circuit. An active pixel circuit is disclosed in the following Japanese Patent Laid-Open No. Hei 8-234683 (referred to as Patent Document 1), JP-A-2002-514320, and Japanese Patent Application Laid-Open No. 2005-173434 (hereinafter referred to as Patent Document 2, and Patent Document 3, respectively).

FIG. 1 is a circuit diagram illustrating the simplest configuration of a pixel circuit in the past. As shown in the figure, the pixel circuit is disposed where a scan line, arranged in a row direction to supply a control signal, and a data line, arranged in a column direction to supply a video signal, intersect each other. The pixel circuit includes a sampling transistor T4, a capacitor C, a drive transistor T1 and a light-emitting device OLED. The light-emitting device is, for example, an organic EL device. The sampling transistor T4 conducts in response to the control signal from the scan line so as to sample the video signal from the data line. The capacitor C retains an input voltage commensurate with the video signal sampled. The drive transistor T1 supplies an output current during a given light-emitting period in accordance with the input voltage retained by the capacitor C. It is to be noted that the output current typically has dependence on a carrier mobility p in the channel region of the drive transistor T1 and a threshold voltage Vth of the same transistor T1. The light-emitting device OLED emits light at the brightness commensurate with the video signal by the output current from the drive transistor T1. It is to be noted that, in the example illustrated, one current path end (source) of the drive transistor T1 is connected to a power supply potential VDD, and the other current path end (drain) to the anode of the light-emitting device OLED. The cathode of the light-emitting device OLED is connected to a ground potential GND.

As the input voltage, retained by the capacitor C, is applied to a gate G of the drive transistor T1, the transistor T1 allows an output current to flow from its source to its drain, thus supplying the current to the light-emitting device OLED. Typically, the light-emission brightness of the light-emitting device OLED is proportional to the amount of current supplied. Further, the amount of output current supplied from the drive transistor T1 is controlled according to a gate voltage, that is to say, the input voltage written to the capacitor C. With a pixel circuit in the past, the amount of current supplied to the light-emitting device OLED is controlled by varying the input voltage applied to the gate G of the drive transistor T1 according to the input video signal.

Here, the operating characteristic of the drive transistor T1 is expressed by a formula 1 shown below.

$$Ids=(1/2)\mu(W/L)Cox(Vgs-Vth)^2 \quad (1)$$

In this transistor characteristic formula 1, Ids is a drain current flowing from the source to the drain. This current is an output current supplied to the light-emitting device OLED in the pixel circuit. Vgs is a gate voltage applied to the gate relative to the source. In the pixel circuit, Vgs is the aforementioned input voltage. Vth is a transistor threshold voltage. μ is a mobility of a semiconductor thin film making up a transistor channel. W is a channel width, L a channel length, and Cox a gate capacitance. As is clear from the transistor characteristic formula 1, if the gate voltage Vgs exceeds the threshold voltage Vth during the operation of a thin film transistor in a saturated region, the transistor turns on, causing the drain current Ids to flow. In terms of the operating principle, the same amount of the drain current Ids is supplied to the light-emitting device OLED at all times so long as the gate voltage Vgs remains constant, as shown in the transistor characteristic formula 1. Therefore, if a video signal having the same level is supplied to all pixels making up the screen, all the pixels will emit light at the same brightness. This should provide a screen uniformity.

In reality, however, thin film transistors (TFTs) which include semiconductor thin films such as polysilicon vary one from another in device characteristics. In particular, the threshold voltage Vth is not constant and instead varies from one pixel to. another. As is clear from the transistor characteristic formula 1, variations in the drive transistor threshold voltage Vth lead to variations in the drain current Ids even if the gate voltage Vgs remains constant. This leads to variations in brightness from one pixel to another, thus degrading the screen uniformity. As a result, pixel circuits have been hitherto developed which incorporate the capability to cancel variations in the threshold voltage of the drive transistor T1. An example thereof is disclosed in Patent Document 2.

A pixel circuit incorporating the capability to cancel variations in the threshold voltage of the drive transistor T1 is capable of improving the brightness change caused by the change over time in the screen uniformity and the threshold voltage. However, as far as the characteristics of the TFT making up the drive transistor are concerned, not only the threshold voltage Vth but also the mobility μ are known to vary from pixel to pixel. Pixel circuits are known which incorporate the capability to correct the mobility p as well as the threshold voltage Vth. An example thereof is disclosed in Patent Document 3.

SUMMARY OF THE INVENTION

The aforementioned pixel circuit having the capability to correct the mobility μ corrects the mobility by negatively feeding the output current from the drive transistor back to the gate of the same transistor basically during a given mobility correction period which is part of the sampling period. The larger the transistor mobility μ, the larger amount of output current is negatively fed back. This reduces the gate voltage (i.e., signal potential) of the drive transistor, thus suppressing the output current. Conversely, if the mobility μ is small, a small amount of current is negatively fed back. As a result, the output current will not decline significantly. Variations in the mobility μ between pixels are corrected in this manner.

As described above, the mobility correction in the past is accomplished by negatively feeding the output current from the drive transistor back to the gate of the same transistor. However, negative feedback inevitably results in the reduction of the gate voltage (signal voltage) of the drive transistor, which in turn will lead to a decline in brightness if no countermeasure is taken. To compensate for the decline in brightness resulting from negative feedback, the video signal amplitude should be set larger in advance. This, however, gives rise to increased power consumption.

Further, in the pixel circuit in the past, the capacitive component connected to the gate of the drive transistor is relatively small. This will quickly reduce the gate voltage as a result of negative feedback. To suppress this reduction, the mobility correction period during which a negative feedback is applied should be set as short as possible. However, setting the mobility correction period too short, or of the order of μs, will lead to variations in the timing control due, for example, to wiring delay, thus making it difficult to perform mobility correction operation in a stable manner. In particular, if the panel is large, wiring delay is significantly large. This leads to difficulties in performing the mobility correction operation in a stable manner. Thus the above difficulties involved in the mobility correction operation have become a problem to be solved.

In light of the foregoing problem of the related art, there is a need for the present invention to provide a pixel circuit capable of implementing an image display apparatus with low power consumption while at the same time stabilizing the capability to correct the mobility of a drive transistor through negative feedback so as to secure sufficient brightness. In order to achieve the above need, the following means are employed. That is, a pixel circuit of an embodiment of the present invention is disposed where a scan line, arranged in a row direction to supply a control signal, and a data line, arranged in a column direction to supply a video signal, intersect each other. The pixel circuit includes a sampling transistor, a drive transistor, a capacitor connected between the current path end of the sampling transistor and the gate of the drive transistor, and a light-emitting device connected to the current path end of the drive transistor. The gate of the sampling transistor is connected to the scan line. One current path end of the sampling transistor is connected to the data line. The other current path end serves as a connection point with the capacitor. The sampling transistor conducts in response to a control signal supplied from the scan line during a given sampling period so as to sample a video signal supplied from the data line. The drive transistor supplies an output current to the light-emitting device according to the video signal sampled. The light-emitting device emits light at the brightness appropriate to the video signal by an output current from the drive transistor. The pixel circuit operates during a correction period set within a sampling period of the video signal to electrically connect the current path end of the drive transistor to the connection point of the sampling transistor, thus negatively feeding the output current back to the connection point during the correction period.

The pixel circuit corrects variations in mobility of the drive transistor through negative feedback of the output current. The pixel circuit includes negative feedback means adapted to negatively feed the output current back to the connection point. Preferably, the negative feedback means include a switching transistor connected between the current path end of the drive transistor and the connection point of the sampling transistor. The switching transistor conducts in response to a control signal applied to the gate during the correction period, electrically connecting the current path end of the drive transistor to the connection point of the sampling transistor. Alternatively, the negative feedback means include a switching transistor connected between the current path end of the drive transistor and the data line. The switching transistor conducts in response to a control signal applied to the gate during the correction period, electrically connecting the current path end of the drive transistor to the connection point via the sampling transistor which is conducting during the sampling period. The pixel circuit includes a switching transistor connected between the gate and the current path end of the drive transistor. The switching transistor turns on ahead of the sampling of the video signal to write a voltage equivalent to a threshold voltage of the drive transistor to the gate.

A pixel circuit of the embodiment of the present invention is disposed where a scan line, arranged in a row direction to supply a control signal, and a data line, arranged in a column direction to supply a video signal, intersect each other. The pixel circuit includes a sampling transistor, a drive transistor, a capacitor connected to the gate of the drive transistor, and a light-emitting device connected to the drive transistor. The sampling transistor conducts in response to a control signal from the scan line during a given sampling period so as to sample a video signal from the data line onto the capacitor. The drive transistor supplies an output current to the light-emitting device according to the video signal sampled. The light-emitting device emits light at the brightness appropriate to the video signal by an output current from the drive transistor. The pixel circuit includes a first switching transistor and a second switching transistor separate from the first switching transistor. The first switching transistor turns on ahead of the sampling of the video signal to write a voltage equivalent to a threshold voltage of the drive transistor to the capacitor. The second switching transistor operates for a correction period set within a sampling period of the video signal to negatively feed the output current back to the capacitor during the correction period.

According to the embodiment of the present invention, a switching transistor making up negative feedback means connects the current path end (e.g., drain) of the drive transistor to the connection point (hereinafter may be called "input side node") between the current path end of the sampling transistor and the capacitor, after the sampling of the video signal. The operation of this switching transistor negatively feeds an output current flowing through the drive transistor back to the input side node, thus causing a change in the potential. The input side node and the gate of the drive transistor are coupled in an AC fashion by the capacitor. As a result, the gate voltage of the drive transistor changes. The change of the input side node causes the absolute value of the gate voltage Vgs of the drive transistor to decline. The larger the drive transistor output current, the more conspicuous this function becomes. Therefore, if there is a difference in driving capability of the drive transistor (i.e., mobility μ) between pixels, a drive current is caused to decrease. This allows for correction of variations in the mobility μ of the drive transistor, thus providing an image display apparatus with an excellent brightness uniformity.

In particular, the embodiment of present invention has a switching transistor serving exclusively as the negative feedback means. The switching transistor electrically connects the current path end (e.g., drain) of the drive transistor and the input side node of the capacitor. As the switching transistor is controlled to turn on during a sampling period, the sampling transistor is also conducting. As a result, during the mobility correction period, the current path end of the drive transistor and the data line are electrically connected via the conducting sampling transistor. The data lines are typically disposed from top to bottom of the panel. As a result, these lines have a relatively large parasitic capacitance. Therefore, the capacitive component of the input side node is relatively large, causing the potential of the input side node to increase at a relatively slow pace during the mobility correction period. That is, the reduction of the gate voltage Vgs of the drive transistor takes place relatively slowly. Thus the timing control need be performed equally slowly during the mobility correction period. This makes it possible to correct variations in the mobility μ in a stable manner even in the event of an increased wiring delay resulting from a larger panel.

DETAILED DESCRIPTION OF THE PREFERRED EMBODIMENTS

Figure 1:
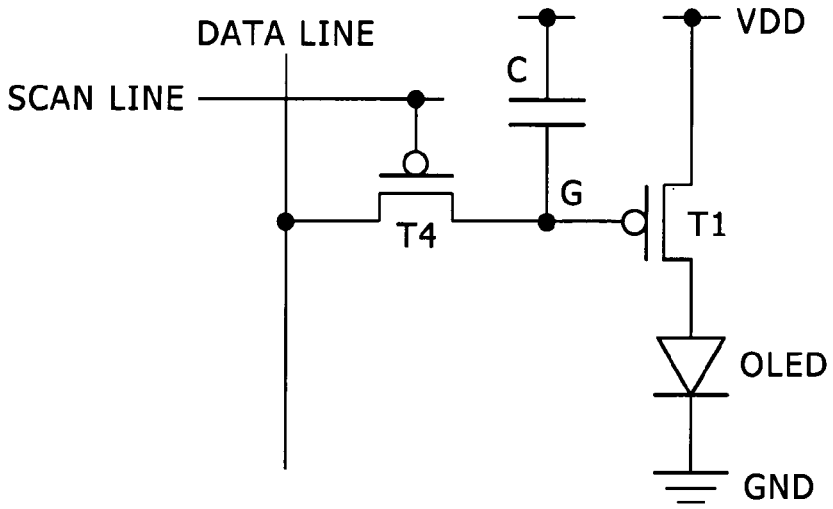
FIG. 1 is a circuit diagram illustrating an example of a pixel circuit in the past.
Figure 2:
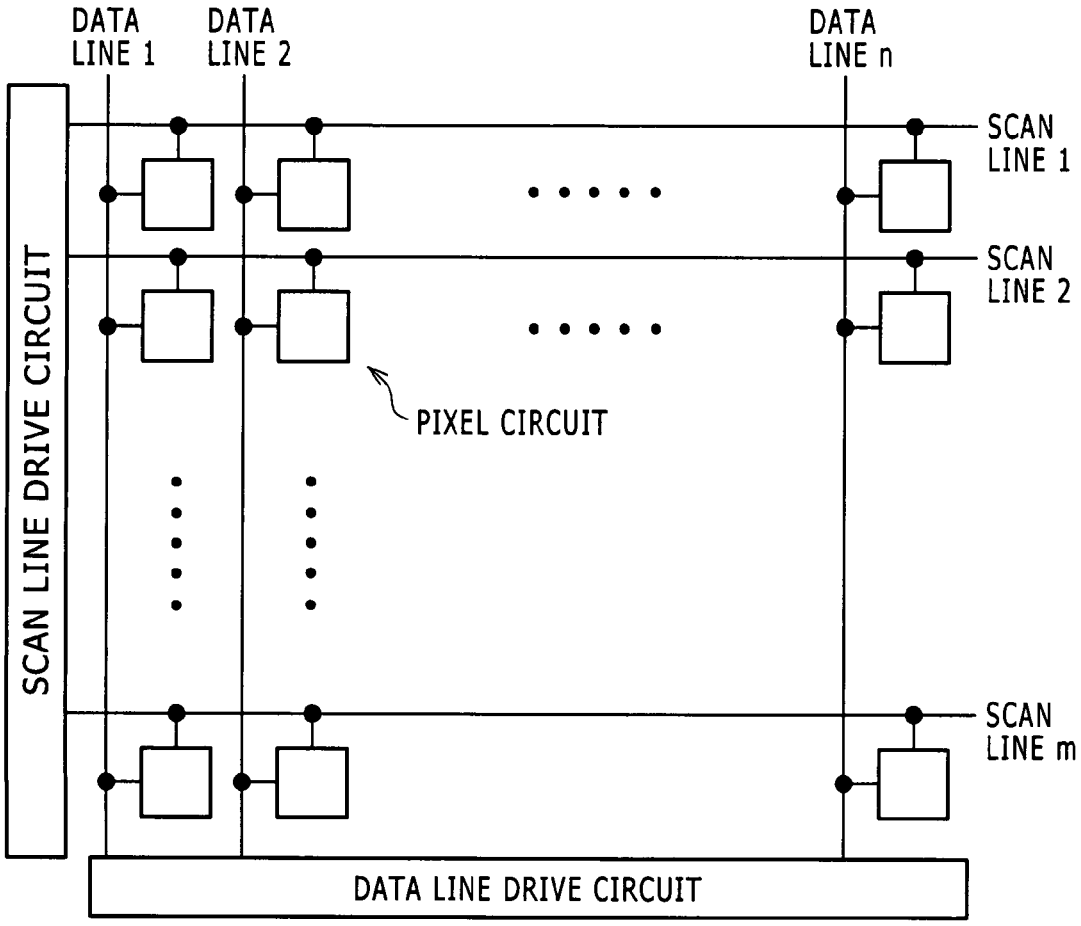
FIG. 2 is a block diagram illustrating the overall configuration of an image display apparatus incorporating a pixel circuit associated with an embodiment of the present invention.

Preferred embodiments of the present invention will be described in detail below with reference to the accompanying drawings. FIG. 2 is a block diagram illustrating the overall configuration of an image display apparatus having a pixel circuit associated with an embodiment of the present invention which is integrated into an IC. As shown in the figure, the image display apparatus includes a pixel array unit in the center and a data line drive circuit and a scan line drive circuit which are provided around the pixel array unit. The pixel array unit includes scan lines 1 to m arranged in row directions, data lines 1 to n arranged in column directions, and pixel circuits each disposed where a scan line and a data line intersect each other. The scan line drive circuit is connected to the scan lines 1 to m and sequentially supplies a control signal for linear sequential scanning of the same circuits. The data line drive circuit is connected to the data lines 1 to n. and supplies a video signal to each of the pixel circuits.

Figure 3:
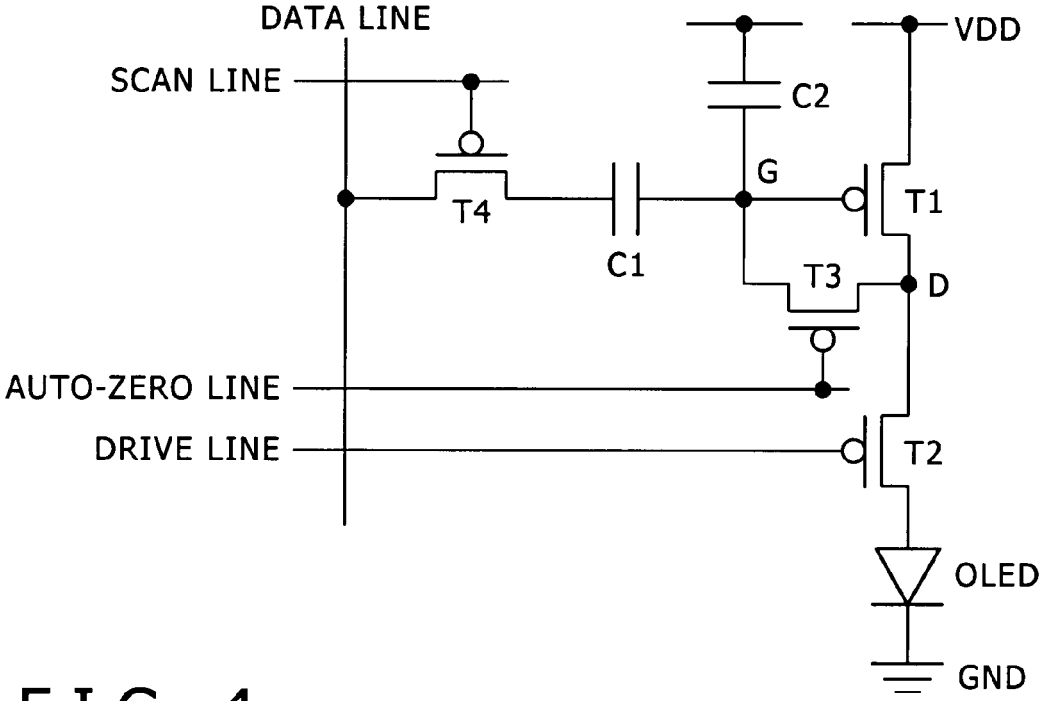
FIG. 3 is a circuit diagram illustrating a reference example of a pixel circuit.

FIG. 3 is a circuit diagram illustrating a configuration example of the pixel circuit illustrated in FIG. 2. It is to be noted that this pixel circuit is a reference example on which the present invention is based. The reference example will be described briefly as it is useful to clarify the background of the present invention. The pixel circuit includes four P-channel transistors T1 to T4, two capacitors C1 and C2 and a light-emitting device OLED. Of the four transistors T1 to T4, T1 is a drive transistor, T2 and T3 are switching transistors, and T4 is a sampling transistor. One current path end (source) of the drive transistor T1 is connected to a power supply potential VDD. The other current path thereof (drain D) is connected to the anode of the light-emitting device OLED via the switching transistor T2. The cathode of the light-emitting device OLED is connected to a ground potential GND. The gate of the switching transistor T2 is connected to a drive line arranged in parallel with a scan line. The drain D of the driving transistor T1 is connected to the gate G of the same transistor T1 via the other switching transistor T3. The capacitor C2 is connected between the gate G and a given power supply potential. An auto-zero line, arranged in parallel with the scan line, is connected to the gate of the switching transistor T3. One current path end of the sampling transistor T4 is connected to one end of the capacitor C1. This connection point may be referred to as an input node in the present specification. The other end of the capacitor C1 is connected to the gate G of the drive transistor T1. The other current path end of the sampling transistor T4 is connected to the data line. As a result, the current path end of the sampling transistor T4 and the control end (gate G) of the drive transistor T1 are connected together in an AC fashion by the coupling capacitor C1. The scan line is connected to the gate of the sampling transistor T4.

Figure 4:
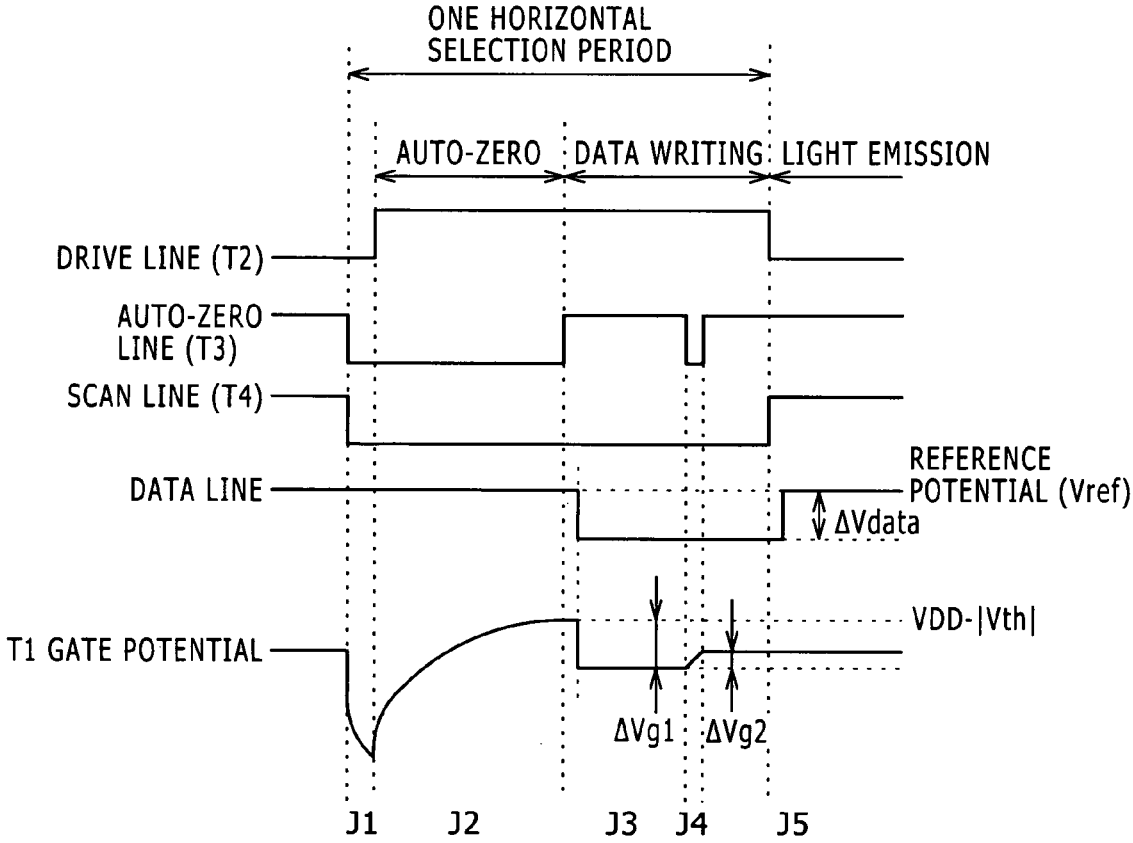
FIG. 4 is a timing diagram used for a description of the operation of the pixel circuit illustrated in FIG. 3.

FIG. 4 is a timing diagram used for a description of the operation of the pixel circuit illustrated in FIG. 3. FIG. 4 illustrates not only the changes in potential (i.e., control signal waveforms) of the drive, auto-zero and scan lines respectively connected to the control ends (gates) of the transistors T2, T3 and T4 but also the change in signal potential of the data line. This figure also presents a waveform showing the change in gate potential of the drive transistor T1.

First in a preparatory period J1, the drive and auto-zero lines are pulled down to a low level, causing the transistors T2 and T3 to conduct. At this time, the drive transistor T1 is connected to the light-emitting device OLED in a diode-connected state, causing a drain current to flow through the drive transistor T1.

In a next auto-zero period J2, the drive line is pulled up to high level, causing the switching transistor T2 to become non-conducting. At this time, the scan line is at low level, causing the sampling transistor T4 to conduct, and a reference potential Vref to be applied to the data line. As the current flow to the drive transistor T1 is shut off, the gate potential of the drive transistor T1 increases. However, when this potential rises to a level VDD-|Vth|, the drive transistor T1 will be non-conducting, causing the potential to stabilize. This operation may be hereinafter referred to as "auto-zero operation." This auto-zero operation allows a voltage equivalent to the threshold voltage Vth of the drive transistor T1 to be written to the gate G.

In a next data writing period J3, the auto-zero line swings to high level, causing the switching transistor T3 to be non-conducting. Further, the data line potential is reduced from Vref by a signal voltage ΔVdata. This change in the data line potential causes the gate potential of the drive transistor T1 to decrease by ΔVg1 via the capacitor C1.

In a mobility correction period J4 set within the data writing period J3, the auto-zero line is pulled down to low level for a short period of time, causing the switching transistor T3 to temporarily conduct. At this time, the drive transistor T1 is conducting, causing a current to flow from the source to the drain D of the same transistor T1. This current is negatively fed back to the gate G of the drive transistor T1 via the switching transistor T3. This negative feedback operation causes the gate potential of the drive transistor T1 to increase. When the gate potential increases by ΔVg2, the auto-zero line swings back to a high level, causing the switching transistor T3 to turn off (non-conducting).

In a light emission period J5, the scan line is pulled up to a high level, causing the sampling transistor T4 to be non-conducting. The drive line is pulled down to a low level, causing the switching transistor T2 to conduct. As a result, an output current flows through the drive transistor T1 and the light-emitting device OLED, causing the same device OLED to start emitting light.

In the data writing during the above data writing period J3, ΔVg1 and a gate potential Vg of the drive transistor T1 are expressed respectively by the following formulas 2 and 3 if parasitic capacitance is ignored:

$$\Delta Vg1=\Delta V\text{data}\times C1/(C1+C2) \quad (2)$$

$$Vg=VDD-|Vth|-\Delta V\text{data}\times C1/(C1+C2) \quad (3)$$

Here, the case is considered in which the mobility correction operation is not performed during the mobility correction period J4. In this case, the control proceeds to a light emission period J5 when the data writing period J3 ends. Assuming the current flowing through the light-emitting device OLED in the light emission period J5 to be Ioled, the amount of this current Ioled is controlled by the drive transistor T1 which is connected in series with the light-emitting device OLED. Assuming that the drive transistor T1 operates in its saturation region, Ioled is expressed as follows by formula 4 using the well-known MOS transistor characteristic formula 1 and the above two formulas:

$$Ioled=\mu\cdot\text{Cox}(W/L)(1/2)(VDD-Vg-|Vth|)^2=\mu\cdot\text{Cox}(W/L)(1/2)(\Delta V\text{data}\times C1/(C1+C2)^2 \quad (4)$$

where μ is a mobility of the majority carrier in the drive transistor T1, Cox a gate capacitance per unit area, W a gate width, and L a gate length. According to the above formula 4, Ioled is controlled by a signal voltage ΔVdata which is externally given irrespective of the threshold voltage Vth of the drive transistor T1. In other words, the pixel circuit illustrated in FIG. 3 is immune to pixel-to-pixel variations in the threshold voltage Vth of the drive transistor, thus providing a display device with a relatively high current uniformity, and in its turn, a relatively high brightness uniformity.

According to the above formula 4, however, it is clear that variations in the mobility μ between pixels lead directly to variations in the output current Ioled. In the timing diagram shown in FIG. 4, therefore, the mobility μ is corrected in the mobility correction period J4 set within the data writing period J3. If the auto-zero line is pulled down to a low level for a short period of time during the correction period J4, the gate potential of the drive transistor T1 increases by ΔVg2 as a result of a current flowing through the same transistor T1. This causes the amount of current flowing from the drive transistor T1 into the light-emitting device OLED to decrease in the light emission period J5. This function of reducing the gate potential is termed negative feedback operation in the present specification. The larger the mobility μ of the drive transistor T1, the more the gate voltage Vgs (potential difference between the gate and source) of the same transistor T1 diminishes by the negative feedback operation. Therefore, it is clear that variations in the mobility μ are corrected by the mobility correction operation illustrated in the timing diagram of FIG. 4.

If the aforementioned negative feedback operation is set too long, the amount of current flowing from the drive transistor T1 into the light-emitting device OLED decreases, resulting in failure to achieve the desired brightness. Therefore, the negative feedback time should be kept to within a certain limit. On the other hand, the drive transistor T1 commonly has a large current driving capability to drive the light-emitting device OLED. The capacitors C1 and C2 need to be formed within a small pixel. Therefore, their capacitances are limited. This makes the T1 gate potential more likely to increase at a fast pace at the time of the negative feedback operation. More specifically, the T1 current of 1 uA and the C2 capacitance of about 500 fF are practical from a panel design viewpoint. In this case, assuming the negative feedback time to be 3 μs, the increase in the gate potential is as follows:

$$\Delta Vg2=1\text{ uA}\times 3\ \mu\text{s}/500\text{ fF}=6\text{ [V]}$$

That is, the negative feedback operation reduces Vgs as much as 6V. In this case, the data line should be driven in advance with an amplitude sufficiently larger than the reduction of Vgs. However, this is not practically acceptable from the standpoint of power consumption, cost of the driver to drive the data line and so on. A shorter negative feedback time may be an option to ease this problem. However, the auto-zero line, adapted to control the negative feedback time, has a wiring delay. As a result, selection and deselection operations are difficult to perform in a short period of time particularly if the panel is large.

Figure 5:
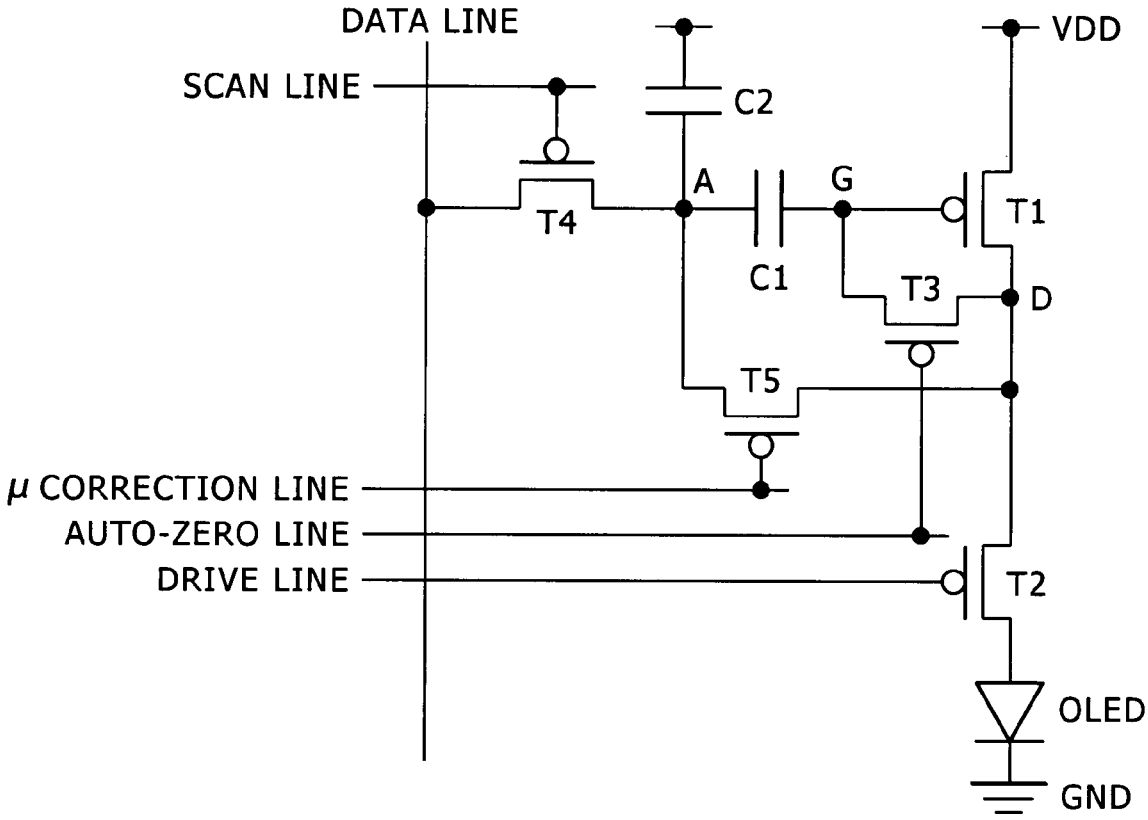
FIG. 5 is a circuit diagram illustrating a first embodiment of the pixel circuit associated with the embodiment of the present invention.

FIG. 5 is a circuit diagram illustrating a first embodiment of the pixel circuit associated with the embodiment of the present invention. To facilitate the understanding thereof, like components as those of the pixel circuit associated with the reference example in FIG. 3 are designated by like reference numerals. As illustrated in the figure, the pixel circuit includes five transistors T1 to T5, the two capacitors C1 and C2, and the light-emitting device OLED. As is clear from the comparison with the reference example illustrated in FIG. 4, the pixel circuit has one additional switching transistor T5. The switching transistor T5 makes up the negative feedback means and has been added exclusively for the negative feedback operation. It is to be noted that although PMOS transistors are used as the transistors T1 to T5 in the first embodiment in FIG. 5, the present invention is not limited thereto. In particular, the transistors T2 to T5 are simple switches. Therefore, all or some of the PMOS transistors may be replaced with NMOS transistors or other switching devices.

This pixel circuit is basically disposed where a scan line, arranged in a row direction to supply a control signal, and a data line, arranged in a column direction to supply a video signal, intersect each other. The pixel circuit includes at least the sampling transistor T4, the drive transistor T1, the capacitor C1 connected between the current path end of the sampling transistor T4 and the gate G of the drive transistor T1. The pixel circuit further includes the capacitor C2 connected between one end of the capacitor C1 and a given power supply potential, and the light-emitting device OLED connected to the current path end (drain D) of the drive transistor T1. The gate of the sampling transistor T4 is connected to the scan line. One current path end of the same transistor T4 is connected to the data line, whereas the other current path end thereof serves as a connection point A with the capacitor C1. The sampling transistor T4 conducts in response to a control signal supplied from the scan line during a given sampling period so as to sample the video signal supplied from the data line. The drive transistor T1 supplies an output current to the light-emitting device OLED during a given light-emitting period in accordance with the video signal sampled. The light-emitting device OLED emits light at the brightness commensurate with the video signal by the output current from the drive transistor T1. The pixel circuit is characterized in that it has negative feedback means. The negative feedback means operate during a correction period set within a sampling period of the video signal to electrically connect the drain D of the drive transistor T1 to the connection point A of the sampling transistor T4, thus negatively feeding the output current back to the connection point A and correcting the mobility μ during the correction period.

In the present embodiment, the switching transistor T5 makes up the negative feedback means. The same transistor T5 intervenes between the drain D of the drive transistor T1 and the connection point A of the sampling transistor T4. This switching transistor T5 conducts in response to a control signal applied to the gate thereof during the correction period to electrically connect the drain D of the drive transistor T1 to the connection point A of the sampling transistor T4. This pixel circuit includes the separate switching transistor T3 connected between the gate G and the drain D of the drive transistor T1. The switching transistor T3 turns on ahead of the sampling of the video signal to write a voltage equivalent to the threshold voltage Vth of the drive transistor T1 to the gate G thereof.

Figure 6:
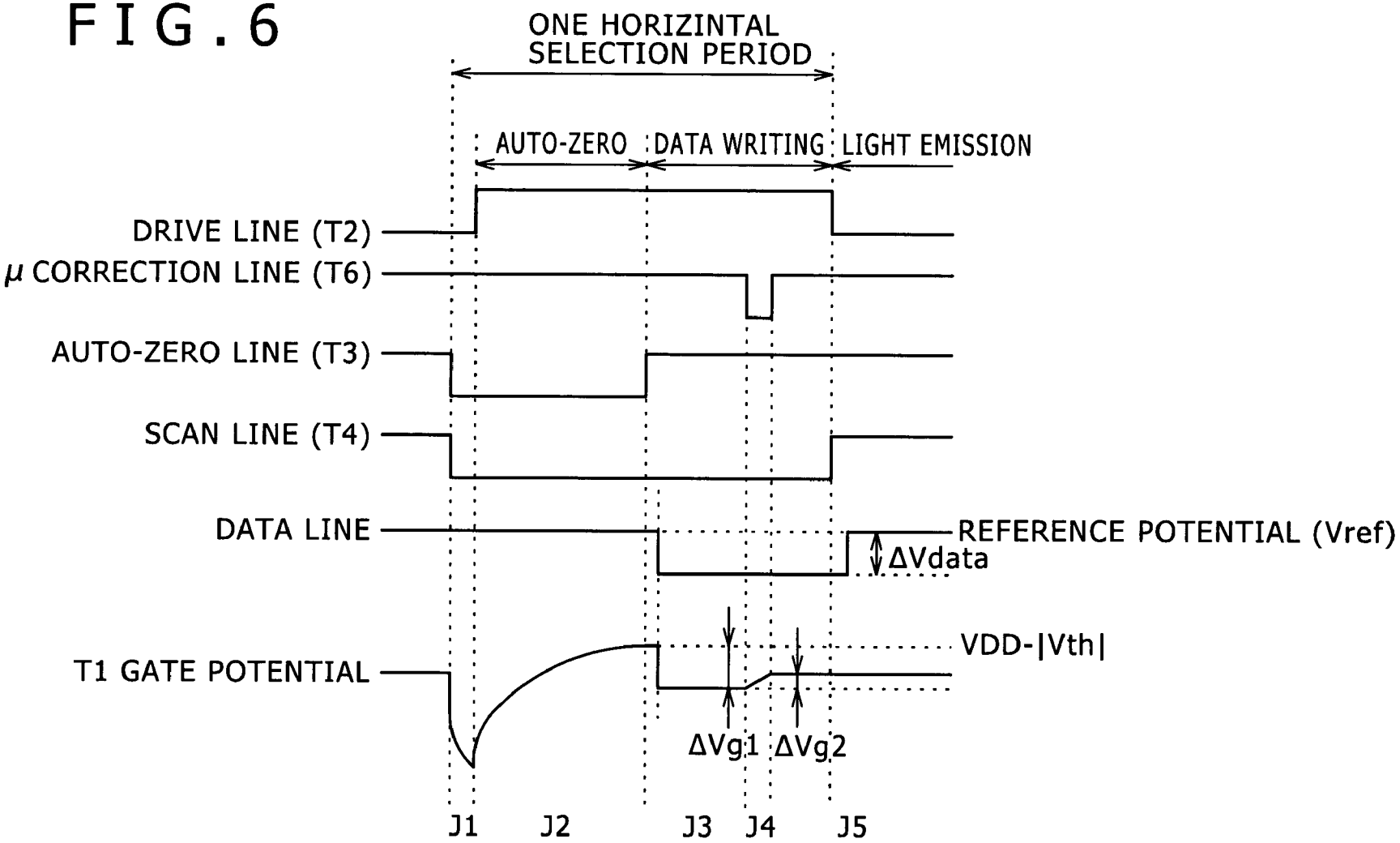
FIG. 6 is a timing diagram used for a description of the operation of the first embodiment.

FIG. 6 is a timing diagram used for a description of the operation of the pixel circuit illustrated in FIG. 5. To facilitate the understanding thereof, like reference numerals are used to designate like components as those illustrated in the timing diagram of FIG. 4. First in the preparatory period J1, the drive and auto-zero lines are pulled down to low level, causing the switching transistors T2 and T3 to conduct. At this time, the drive transistor T1 is connected to the light-emitting device OLED in a diode-connected state, causing a current to flow through the drive transistor T1.

In the next auto-zero period J2, the drive line is pulled up to high level, causing the switching transistor T2 to non-conducting. At this time, the scan line is at low level, causing the sampling transistor T4 to conduct, and a reference potential Vref to be applied to the data line. As the current flow to the drive transistor T1 is shut off, the gate potential of the drive transistor T1 increases. However, when this potential rises to a level VDD-|Vth|, the drive transistor T1 will non-conducting, causing the potential to stabilize.

In the next data writing period J3, the auto-zero line swings to a high level, causing the switching transistor T3 to be non-conducting. Further, the data line potential is reduced from Vref by ΔVdata. This change in the data line potential causes the gate potential of the drive transistor T1 to decrease by ΔVg1 via the capacitor C1.

In the correction period J4 set particularly within the data writing period J3, a μ correction line, connected to the gate of the switching transistor T5, is pulled down to a low level for a short period of time, causing the switching transistor T5 to conduct. At this time, the drive transistor T1 is conducting as a result of the data writing operation, causing a current to flow from the source to the drain D of the same transistor T1. This current is negatively fed back to the connection point A with the capacitor C1 via the switching transistor T5. As a result, the input side potential of the capacitor C1 increases, causing the gate potential of the drive transistor T1 to increase. When the gate potential increases by ΔVg2, the μ correction line rises to a high level, causing the switching transistor T5 to be non-conducting.

In the light emission period J5, the scan line is pulled up to a high level, causing the sampling transistor T4 to be non-conducting. The drive line is pulled down to a low level, causing the switching transistor T2 to conduct. As a result, an output current flows through the drive transistor T1 and the light-emitting device OLED, causing the same device OLED to start emitting light. It is to be noted that all the aforementioned periods, namely, the preparatory period J1, the auto-zero period J2, and the data writing period J3 including the correction period J4, are all allocated within one horizontal selection period (1H) which is assigned to the pixel.

The first embodiment illustrated in FIGS. 5 and 6 includes the capabilities to cancel variations in Vth and correct variations in the mobility μ, as with the reference example illustrated in FIGS. 3 and 4. Here, the first embodiment is significantly characterized in that the current path end (drain node) of the drive transistor T1 and the input side node of the capacitor C1 are electrically connected by the switching transistor T5 during the correction of variations in the mobility μ. At this time, the sampling transistor T4 is also conducting. As a result, the drain of the drive transistor T1 and the data line are electrically connected. The data lines are typically disposed from top to bottom of the panel. Therefore, these lines have a relatively large stray capacitance. As a result, the data line potential increases at a relatively slow pace when the current from the drive transistor T1 is negatively fed back to the data line during the correction of variations in the mobility μ. As a consequence, the reduction of Vgs takes place slowly in the negative feedback operation. Therefore, the timing control of the μ correction line is performed equally slowly. This makes it possible to correct variations in the mobility μ in a stable manner even in the event of an increased wiring delay of the μ correction line resulting from a larger panel.

Figure 7:
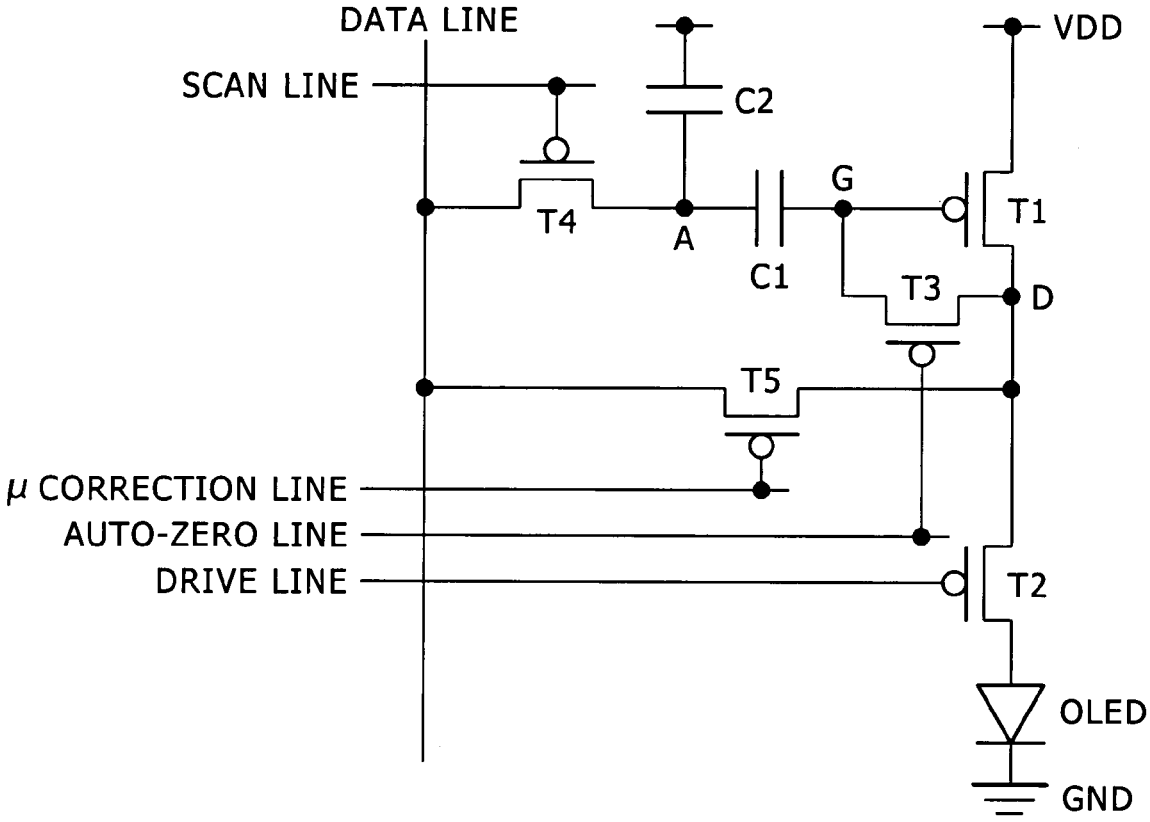
FIG. 7 is a circuit diagram illustrating a second embodiment of the pixel circuit associated with the embodiment of the present invention.

FIG. 7 is a circuit diagram illustrating a second embodiment of the pixel circuit associated with the embodiment of the present invention. To facilitate the understanding thereof, like components as those of the first embodiment in FIG. 5 are designated by like reference numerals. The second embodiment differs from the first embodiment in that the switching transistor T5 making up the negative feedback means is connected between the current path end (drain D) of the drive transistor T1 and the data line. The control end (gate) of the same transistor T5 is connected to the μ correction line which is arranged in parallel with the scan line. The same transistor T5 conducts in response to a control signal applied to the gate thereof during the correction period, thus connecting the drain D of the drive transistor T1 to the connection point A via the data line and further via the sampling transistor T4 which is conducting during the sampling period. As a result, the negative feedback operation is performed with electrical continuity established between the connection point A and the data line, thus providing completely the same effect as with the first embodiment.

Figure 8:
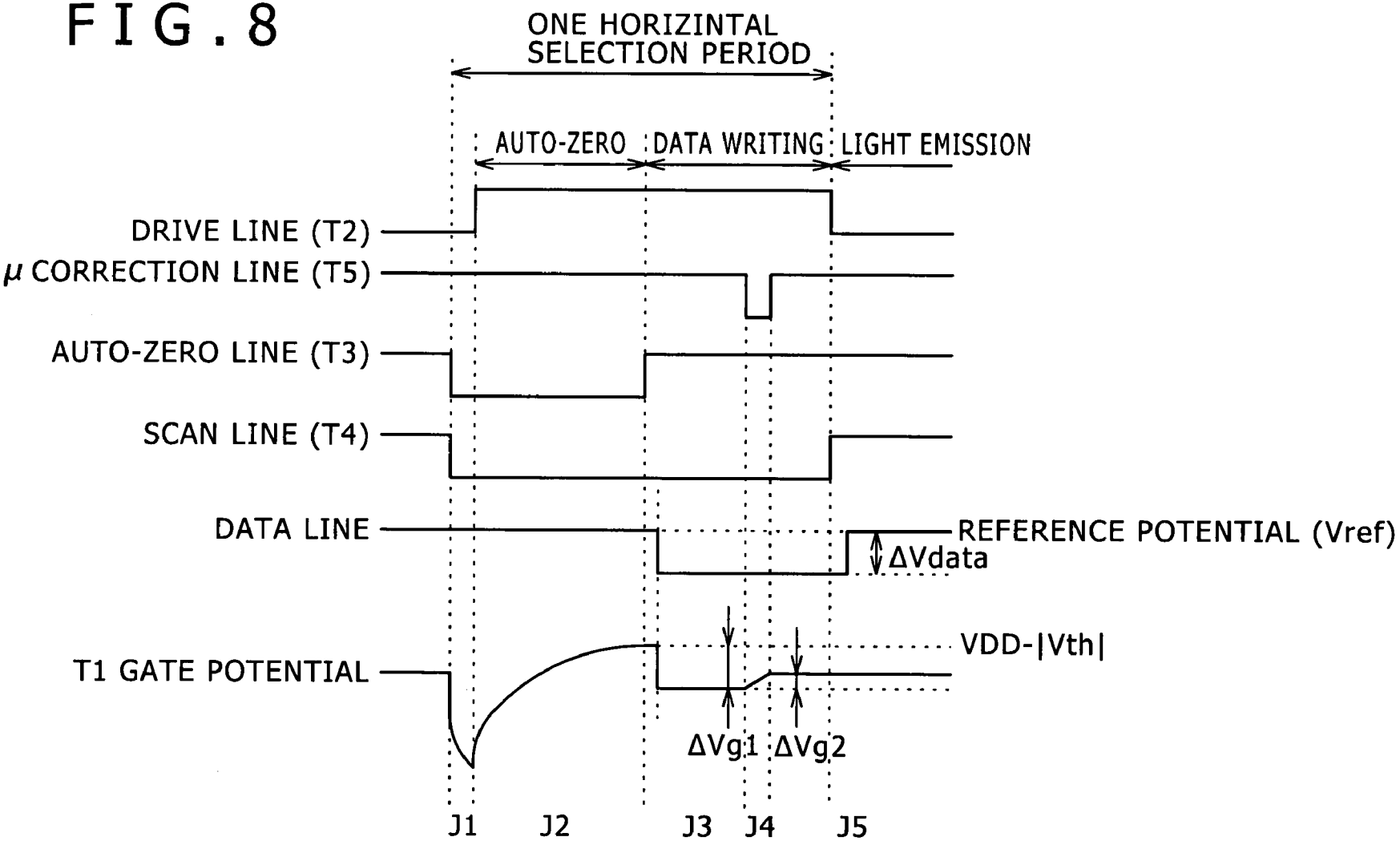
FIG. 8 is a timing diagram used for a description of the operation of the second embodiment.

FIG. 8 is a timing diagram used for a description of the operation of the second embodiment illustrated in FIG. 7. The second embodiment operates in the same manner as the first embodiment. That is, in the correction period J4 set within the data writing period J3, the μ correction line is pulled down to a low level for a short period of time, causing the switching transistor T5 to conduct. At this time, the drive transistor T1 is on, causing a current to flow from its source to its drain. This current flows through the switching transistor T5 onto the data line. As a result, the data line potential increases. Further, the input side potential of the capacitor C1 also increases via the sampling transistor T4 which is conducting. This causes the gate potential of the drive transistor T1 to increase. When the gate potential increases by ΔVg2, the μ correction line rises to a high level, causing the switching transistor T5 to be non-conducting.

Figure 9:
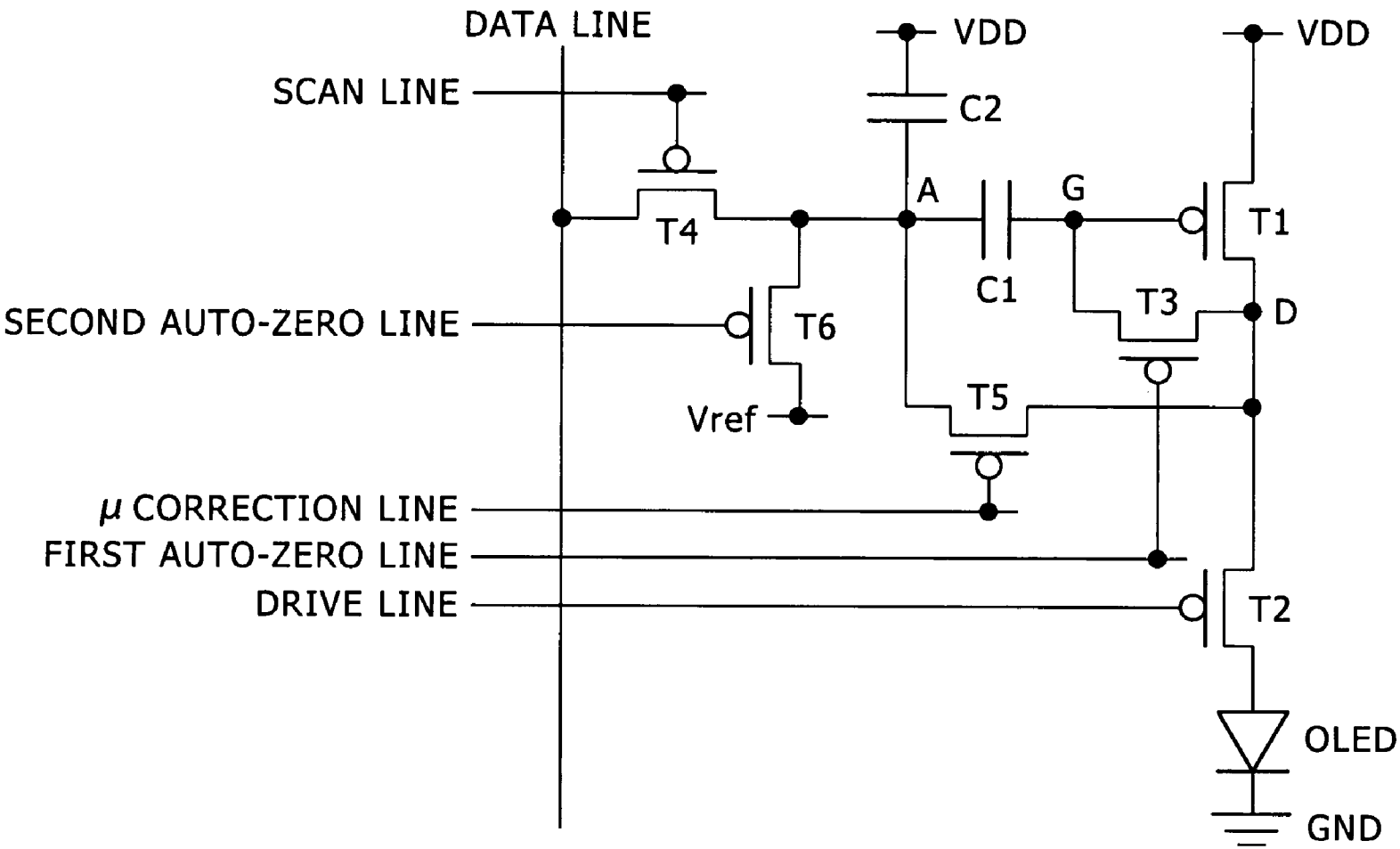
FIG. 9 is a circuit diagram illustrating a third embodiment of the pixel circuit associated with the embodiment of the present invention.

FIG. 9 is a circuit diagram illustrating a third embodiment of the pixel circuit associated with the embodiment of the present invention. The third embodiment is basically similar to the first embodiment. Like components as those of the first embodiment are designated by like reference numerals to facilitate the understanding thereof. The third embodiment differs from the first embodiment in that a switching transistor T6 has been added. One current path end of the same transistor T6 is connected to the connection point A, whereas the other current path end thereof is connected to the reference potential Vref. The gate of the same transistor T6 is connected to a second auto-zero line. It is to be noted that the auto-zero line connected to the gate of the switching transistor T3 is denoted as a first auto-zero line particularly in FIG. 9 for distinction from the second auto-zero line.

Figure 10:
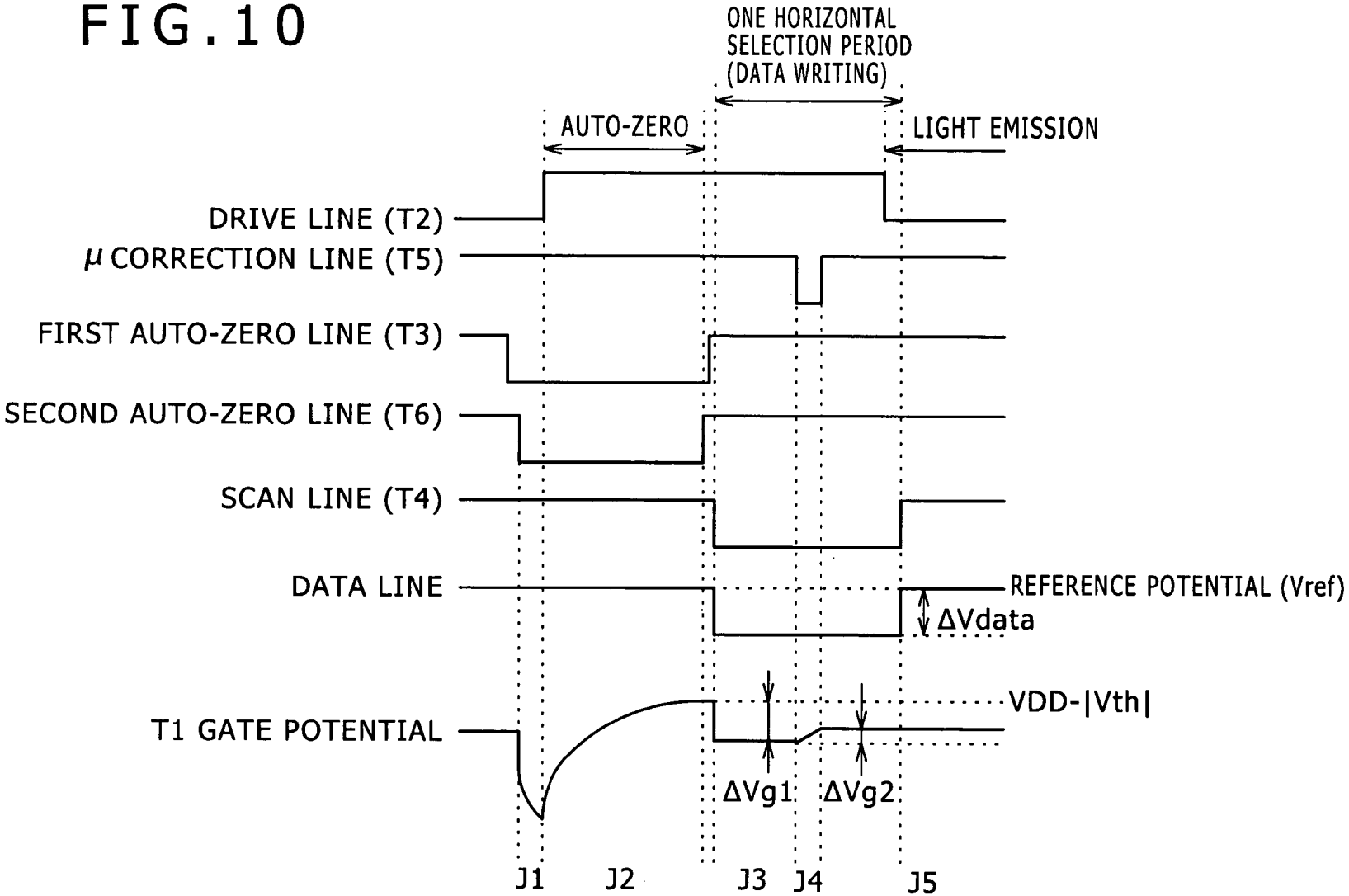
FIG. 10 is a timing diagram used for a description of the operation of the third embodiment.

FIG. 10 is a timing diagram used for a description of the operation of the third embodiment illustrated in FIG. 9. To facilitate the understanding thereof, like reference numerals are used to designate like components as those illustrated in the timing diagram of FIG. 6. In the first embodiment illustrated in FIGS. 5 and 6, the auto-zero and data writing operations are necessary to be carried out within one horizontal selection period (1H). That is, the data line potential is switched between the reference potential Vref and the signal voltage ΔVdata. As a result, the auto-zero and data writing operations should be completed within one horizontal selection period. In contrast, in the present embodiment, the switching transistor T6 has been added to separate the reference potential Vref from the data line so that this potential is set to the connection point A. The switching transistor T6 makes it possible to perform the auto-zero operation ahead of the data writing operation. As a result, the signal waveform on the data line can be simplified, providing more time available for the auto-zero and data writing operations. As is clear from the timing diagram in FIG. 10, the whole of one horizontal selection period (1H) can be spent as the data writing period J3. The timing and duration of the auto-zero period J2 can be set freely so long as the period J2 is provided prior to the horizontal selection period.

Figure 11:
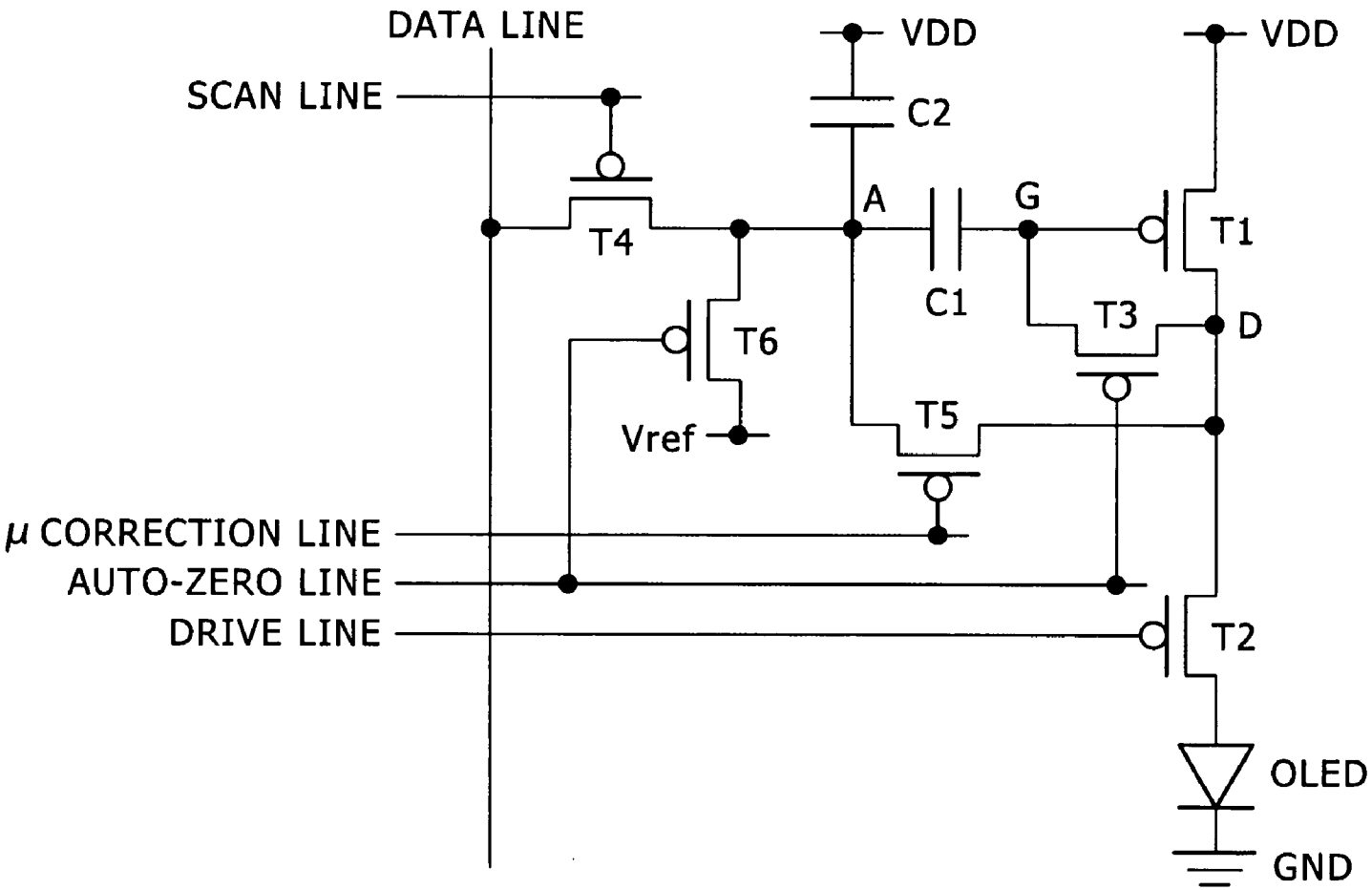
FIG. 11 is a circuit diagram illustrating a fourth embodiment of the pixel circuit associated with the embodiment of the present invention.

FIG. 11 is a circuit diagram illustrating a fourth embodiment of the pixel circuit associated with the embodiment of the present invention. The fourth embodiment is basically similar to and a modified version of the third embodiment illustrated in FIG. 9. In the present embodiment, the first auto-zero line connected to the gate of the switching transistor T3 and the second auto-zero line connected to the gate of the switching transistor T6 have been combined into a single common auto-zero line. This common auto-zero line is used to simultaneously control the on/off state of the switching transistors T3 and T6. This provides a reduced number of control lines arranged in parallel with the scan line.

Figure 12:
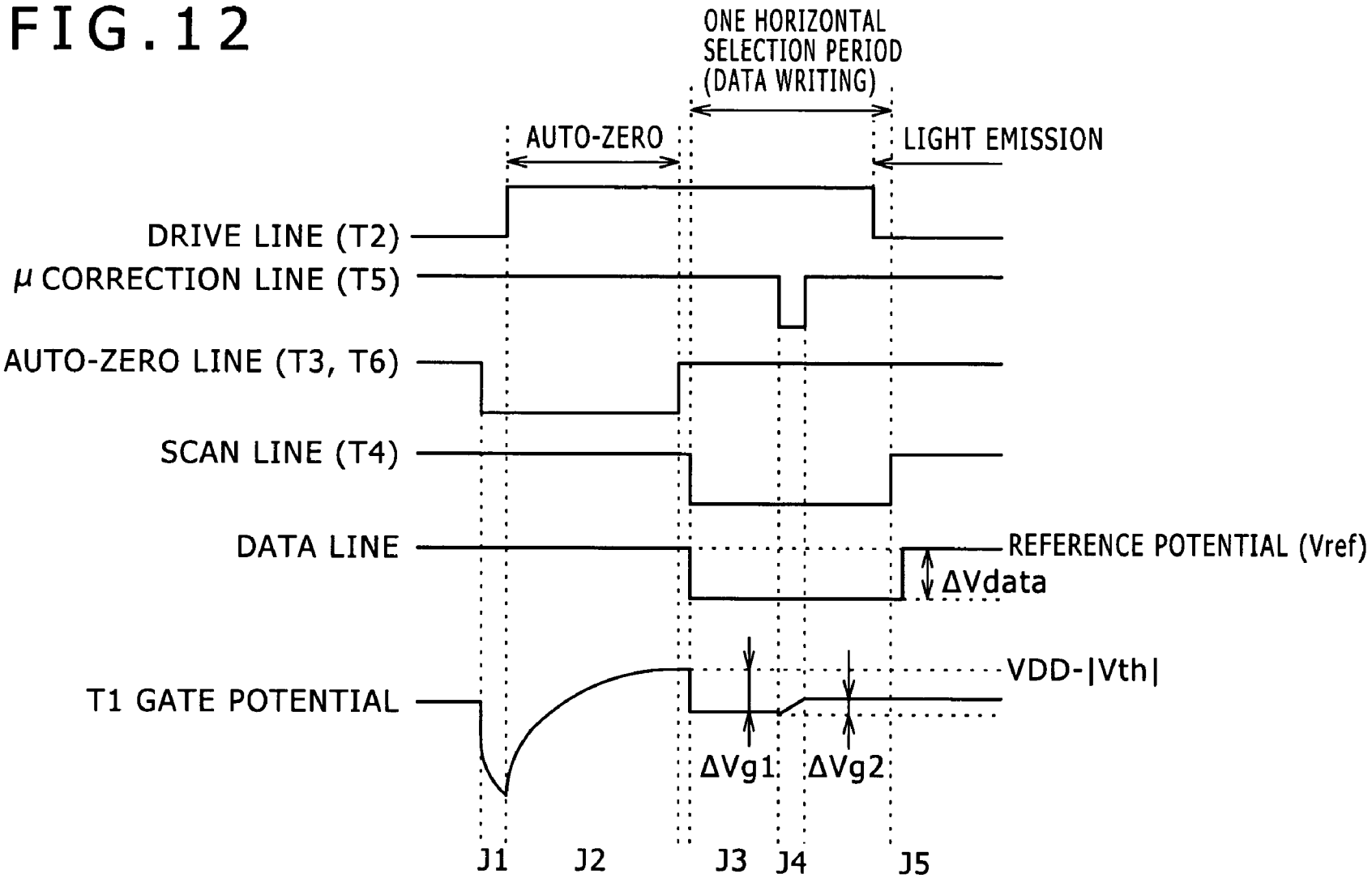
FIG. 12 is a timing diagram used for a description of the operation of the fourth embodiment.

FIG. 12 is a timing diagram used for a description of the operation of the fourth embodiment illustrated in FIG. 11. The auto-zero line swings to a low level in the auto-zero period J2. As a result, the switching transistors T3 and T6 conduct at the same time, performing the given auto-zero operation.

Figure 13:
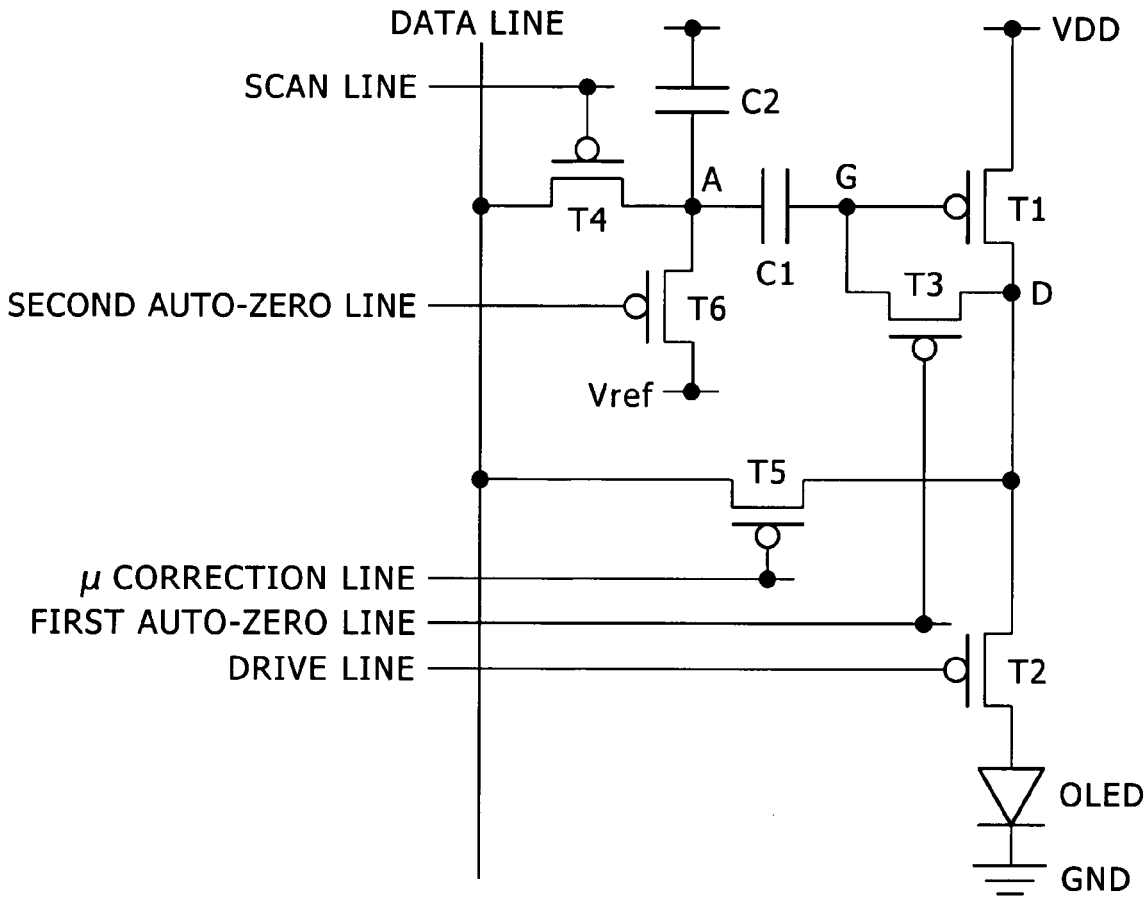
FIG. 13 is a circuit diagram illustrating a fifth embodiment of the pixel circuit associated with the embodiment of the present invention.

FIG. 13 is a circuit diagram illustrating a fifth embodiment of the pixel circuit associated with the embodiment of the present invention. The fifth embodiment is basically similar to the second embodiment illustrated in FIG. 7. The fifth embodiment differs from the second embodiment in that the switching transistor T6 for the auto-zero operation has been added between the reference potential Vref and the connection point A. In this respect, the fifth embodiment is similar in configuration to the third embodiment illustrated in FIG. 9. The operational timing diagram of the present embodiment is similar to that in FIG. 10. As with the third embodiment, the present embodiment allows for the auto-zero operation to be performed ahead of the data writing operation. As a result, the signal waveform on the data line can be simplified, providing more time available for the auto-zero and data writing operations.

Figure 14:
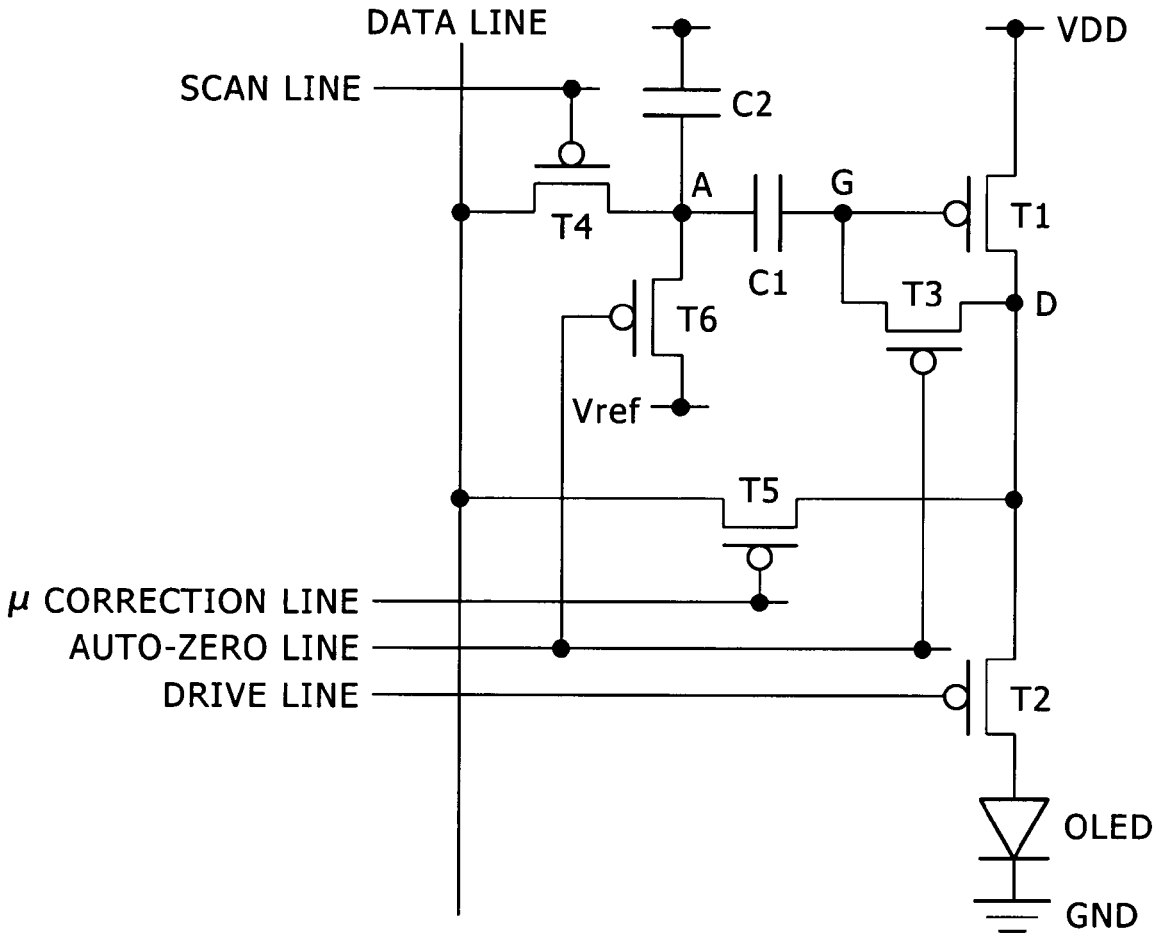
FIG. 14 is a circuit diagram illustrating a sixth embodiment of the pixel circuit associated with the embodiment of the present invention.

FIG. 14 is a circuit diagram illustrating a sixth embodiment of the pixel circuit associated with the embodiment of the present invention. The sixth embodiment is basically similar to the fifth embodiment illustrated in FIG. 13. The sixth embodiment differs from the fifth embodiment in that the auto-zero line is shared by the switching transistors T3 and T6. In this respect, the sixth embodiment is similar to the fourth embodiment. The present embodiment allows for the auto-zero operation to be performed with a single auto-zero line, providing a reduced number of control lines as a whole.

It should be understood by those skilled in the art that various modifications, combinations, sub-combinations and alterations may occur depending on design requirements and other factors insofar as they are within the scope of the appended claims or the equivalents thereof.

What is claimed is:

1. A pixel circuit disposed where a scan line arranged in a row direction to supply a control signal and a data line arranged in a column direction to supply a video signal intersect each other, the pixel circuit comprising:

a sampling transistor;

a drive transistor;

a capacitor connected between the current path end of the sampling transistor and the gate of the drive transistor; and a light-emitting device connected to the current path end of the drive transistor, wherein the gate of the sampling transistor is connected to the scan line, and one current path end of the sampling transistor is connected to the data line, and the other current path end serves as a connection point with the capacitor, the sampling transistor conducts in response to a control signal supplied from the scan line during a given sampling period to sample a video signal supplied from the data line, the drive transistor supplies an output current to the light-emitting device according to the video signal sampled, the light-emitting device emits light at the brightness appropriate to the video signal by an output current from the drive transistor, and the pixel circuit operates during a correction period set within a sampling period of the video signal to electrically connect the current path end of the drive transistor to the connection point of the sampling transistor so as to negatively feed the output current back to the connection point during the correction period.

2. The pixel circuit of claim 1, wherein the circuit corrects variations in mobility of the drive transistor through negative feedback of the output current.

3. The pixel circuit of claim 1, comprising negative feedback means adapted to negatively feed the output current back to the connection point.

4. The pixel circuit of claim 3, the negative feedback means comprising a switching transistor connected between the current path end of the drive transistor and the connection point of the sampling transistor, wherein the switching transistor conducts in response to a control signal applied to the gate during the correction period so as to electrically connect the current path end of the drive transistor to the connection point of the sampling transistor.

5. The pixel circuit of claim 3, the negative feedback means comprising a switching transistor connected between the current path end of the drive transistor and the data line, wherein the switching transistor conducts in response to a control signal applied to the gate during the correction period so as to electrically connect the current path end of the drive transistor to the connection point via the sampling transistor which is conducting during the sampling period.

6. The pixel circuit of claim 1, comprising a switching transistor connected between the gate and the current path end of the drive transistor, wherein the switching transistor turns on ahead of the sampling of the video signal to write a voltage equivalent to a threshold voltage of the drive transistor to the gate.

7. A pixel circuit disposed where a scan line arranged in a row direction to supply a control signal and a data line arranged in a column direction to supply a video signal intersect each other, the pixel circuit comprising:

a sampling transistor;

a drive transistor;

a capacitor connected to the gate of the drive transistor; and a light-emitting device connected to the drive transistor, wherein the sampling transistor conducts in response to a control signal from the scan line during a given sampling period so as to sample a video signal from the data line onto the capacitor, the drive transistor supplies an output current to the light-emitting device according to the video signal sampled, the light-emitting device emits light at the brightness appropriate to the video signal by an output current from the drive transistor, the circuit further includes a first switching transistor and a second switching transistor separate from the first switching transistor, the first switching transistor turns on ahead of the sampling of the video signal to write a voltage equivalent to a threshold voltage of the drive transistor to the capacitor, and the second switching transistor operates for a correction period set within a sampling period of the video signal to negatively feed the output current back to the capacitor during the correction period.

8. A display device comprising:

a scan line arranged in a row direction to supply a control signal;

a data line arranged in a column direction to supply a video signal; and a pixel circuit disposed where the scan and data lines intersect each other, the pixel circuit including at least a sampling transistor, a drive transistor, a capacitor connected between the current path end of the sampling transistor and the gate of the drive transistor, and a light-emitting device connected to the current path end of the drive transistor, wherein the gate of the sampling transistor is connected to the scan line, and one current path end of the sampling transistor is connected to the data line, and the other current path end serves as a connection point with the capacitor, the sampling transistor conducts in response to a control signal supplied from the scan line during a given sampling period to sample a video signal supplied from the data line, the drive transistor supplies an output current to the light-emitting device according to the video signal sampled, the light-emitting device emits light at the brightness appropriate to the video signal by an output current from the drive transistor, and the pixel circuit operates during a correction period set within a sampling period of the video signal to electrically connect the current path end of the drive transistor to the connection point of the sampling transistor so as to negatively feed the output current back to the connection point during the correction period.

* * * * *